United States Patent [19]

Menhennett

[11] 4,050,563

[45] Sept. 27, 1977

[54] APPARATUS FOR SELECTABLE FONT PRINTING

[75] Inventor: Herbert E. Menhennett, Windham, N.H.

[73] Assignee: Centronics Data Computer Corporation, Hudson, N.H.

[21] Appl. No.: 629,020

[22] Filed: Nov. 5, 1975

[51] Int. Cl.[2] ..... B41J 3/04

[52] U.S. Cl. ..... 197/1 R; 101/93.05; 178/30; 340/324 AD

[58] Field of Search ..... 197/1 R, 53; 101/93.05, 101/93.15-93.17; 178/23 R, 26 R, 30; 340/324 AD

[56] References Cited

U.S. PATENT DOCUMENTS

| | | | |
|---|---|---|---|
| 3,703,949 | 11/1972 | Howard et al. | 197/1 R |
| 3,719,781 | 3/1973 | Fulton et al. | 178/30 |
| 3,825,681 | 7/1974 | Cederberg et al. | 197/1 R X |
| 3,831,728 | 8/1974 | Woods et al. | 197/1 R |
| 3,834,505 | 9/1974 | Fowler et al. | 197/1 R |
| 3,891,077 | 6/1975 | Sauerbrunn | 197/1 R |
| 3,893,558 | 7/1975 | Fulton et al. | 101/93.05 X |
| 3,896,428 | 7/1975 | Williams | 340/324 AD |
| 3,905,463 | 9/1975 | Boyce et al. | 197/1 R |

*Primary Examiner*—Ralph T. Rader
*Attorney, Agent, or Firm*—Louis Weinstein

[57] ABSTRACT

Apparatus for use in a dot-matrix type impact printer for printing each line of characters and/or graphic data in a selective one of a plurality of character fonts and/or formats. In one preferred embodiment, a manual selection is made corresponding to either a normal or compressed spacing between adjacent dot columns by selection of a registration array from a group of such arrays. Dual-channel reading means cooperate with the registration arrays for determining the position of a print head as it moves across a print line and for enabling a plurality of print wires to be selectively impacted against the paper document whenever the print head is in proper registration as determined by the selected array. Spacing between registration slits of each array is uniform but is different as between arrays. The selected array may be changed either manually or remotely. Upon completion of the printing of a line, control logic means returns the printer to a "selected" format. Double width characters may be printed utilizing any of the arrays. In an alternative embodiment, a horizontal format may be utilized to permit printing in only selected regions or columns.

16 Claims, 13 Drawing Figures

FIG. 3.
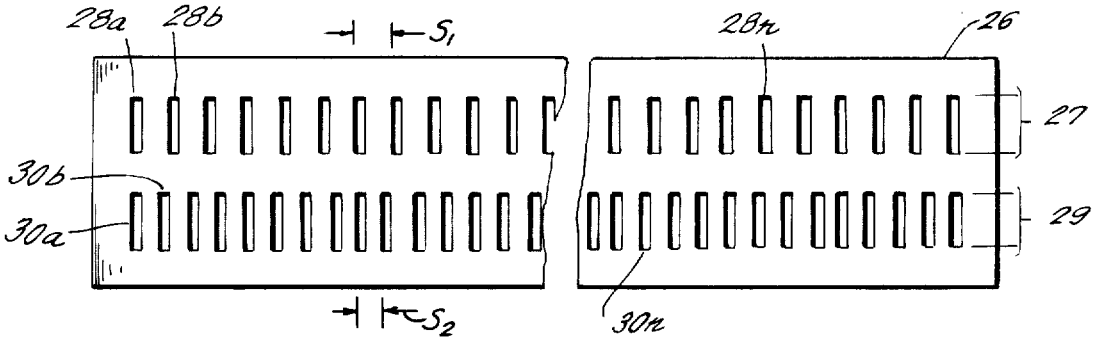
FIG. 2.
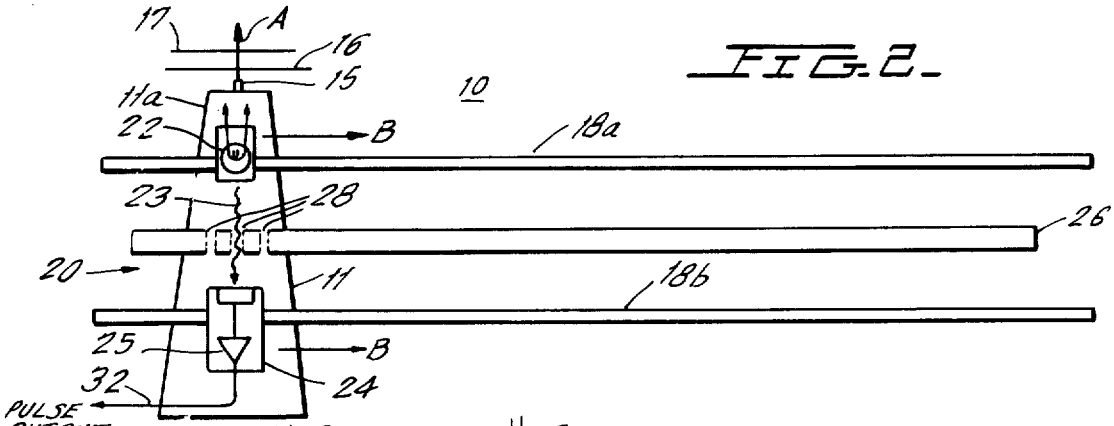
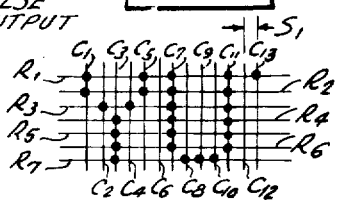
FIG. 4a.
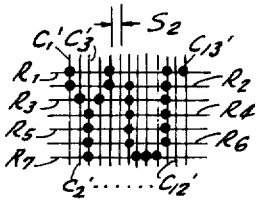
FIG. 4b.
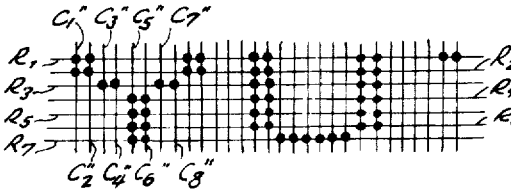
FIG. 4c.
FIG. 5.
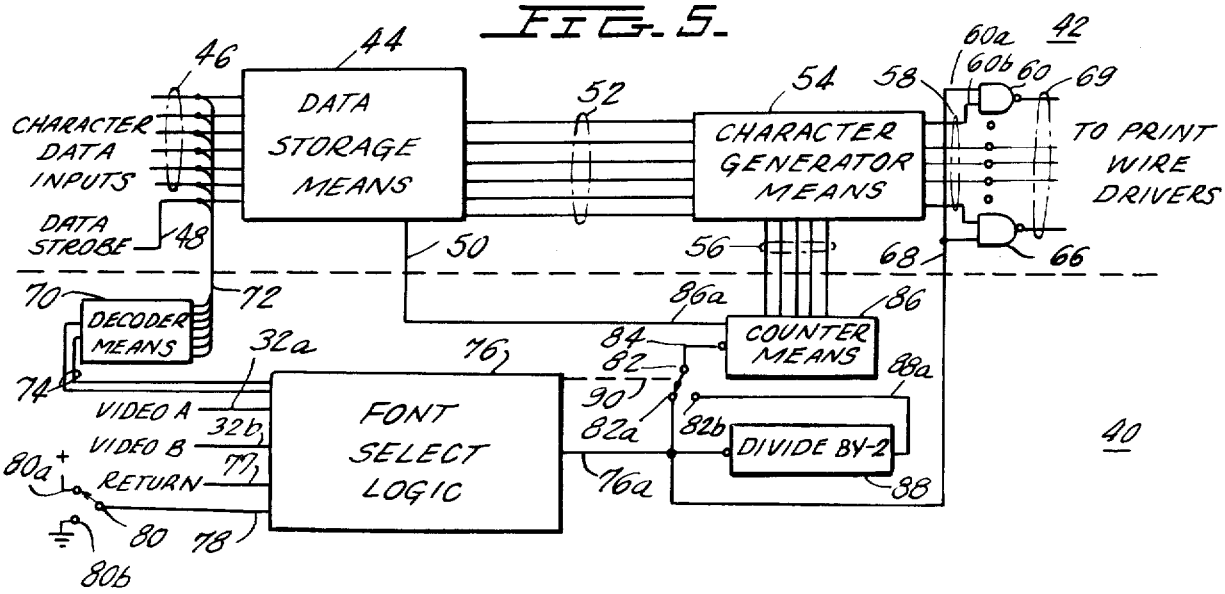

APPARATUS FOR SELECTABLE FONT PRINTING

BACKGROUND OF THE INVENTION

The present invention relates to printing apparatus of the dot matrix type and more particularly to novel apparatus for selectively printing characters in one of a plurality of different font formats.

Line printers of the dot-matrix type are typically comprised of a print head movable across a paper document and capable of printing selected dot positions in a dot column. In one typical embodiment, the dot column has seven dot positions which may be selectively printed in any combination. Five adjacent dot columns collectively comprise a single alphanumeric character or other symbol thereby creating a 5×7 dot matrix wherein the selected printing of the 35 possible dot positions cooperatively form the desired alphanumeric character or other symbol. The print head is generally moved to the left-hand-most position of the paper document to begin the line of printing and then moves across the paper document at a substantially constant rate successively printing dot columns at selected ones of a plurality of uniformly spaced positions along a line until it reaches the right-hand end of the paper document thereby completing a line of print. The print head is then moved in the reverse direction back to the start of left-hand-most position and the paper document is advanced in readiness for printing the next line.

In one typical embodiment, for a size format of ten (10) characters per inch, a maximum of 80 characters may be printed along a line of 8 inch length. It is desirable to compress the width of each dot matrix character to enable printing of a larger amount of characters, typically 96 or 132 characters, along a line of the same length as set forth above, thereby realizing a significant reduction in printing paper usage.

It is also desirable to enable printing of a double-width elongated font of characters for special message, or "capital", characters said double width characters also being of the normal or compressed width. Also, no registration techniques presently in use include the capability of providing a selectable horizontal format.

BRIEF DESCRIPTION OF THE INVENTION

In accordance with the invention, apparatus for font selectable printing in a dot-matrix printer, realizing the above-stated goals, comprises a registration strip having at least first and second uniformly spaced arrays of slits, the uniform spacing between slits in the first array controlling the spacing between successive columns of a dot-matrix character of "normal" width and the uniform spacing of slits in the remaining array being less than the uniform spacing of the first array to print at intervals of decreased spacing and thereby achieve dot matrix characters of compressed width; a light source and cooperating detector means for each array, each cooperating device being positioned on opposite sides of the registration strip in alignment with each array to produce a print strobe signal responsive to passage of light through successive slits of each array, and logic means coupled to the detector means and to the print wire drive means for selectively impacting the print wires against a paper document when the print head is properly aligned relative to each slit in the array.

The light source and detector means are adapted to be moved, together with the print head, across the paper.

Character data is received, stored in data storage means and then sequentially applied to a character generator. Font select logic means receives font selection data and the outputs of the detector means to generate a data storage means output enable signal to control the sequential generation of successive dot columns and to advance the next character code to the character generator after completion of each character.

When printing elongated characters, the data storage means output enable signal is applied to a divide-by-two circuit, whereby the character generator is operated at half the normal print rate, causing each dot column to be printed twice.

A number of applications also require special columnar arrangements such as for accounting or financial statements, purchase orders, business or engineering type reports, data sheets, etc. The registration strip may be tailored to these needs by eliminating registration slits in the regions between columns in which printing is to occur.

Accordingly, it is one object of the present invention to provide apparatus for selectively enabling printing in a dot-matrix type printer in a selected one of a plurality of sizes.

Another object of the present invention is to provide means for selectively enabling printing in a dot-matrix type printer of a font of either normal or compressed width elongated double-width characters.

A further object of the present invention is to provide apparatus for use in a dot-matrix type printer for selectively enabling printing in one of a plurality of font size formats.

Another object of the present invention is to provide a registration strip in which regions thereof are devoid of registration indicia or slits thereby facilitating the printing of special purpose forms and the like.

These and other objects of the present invention will become apparent when reading the accompanying detailed description and the drawings.

BRIEF DESCRIPTION OF THE FIGURES

FIG. 2 is a bottom view of the embodiment of FIG. 1;

FIG. 3 is a front view of one preferred embodiment of a dual font format registration strip used in the apparatus of the invention;

FIGS. 4*a*, 4*b* and 4*c* are illustrations of dot-matrix characters printed in, respectively, a normal font format, a compressed font format and an elongated format;

FIG. 5 is a schematic block diagram of logic means for enabling the printing of the different font formats in the apparatus of the present invention.

DETAILED DESCRIPTION OF THE INVENTION

Figure 1:
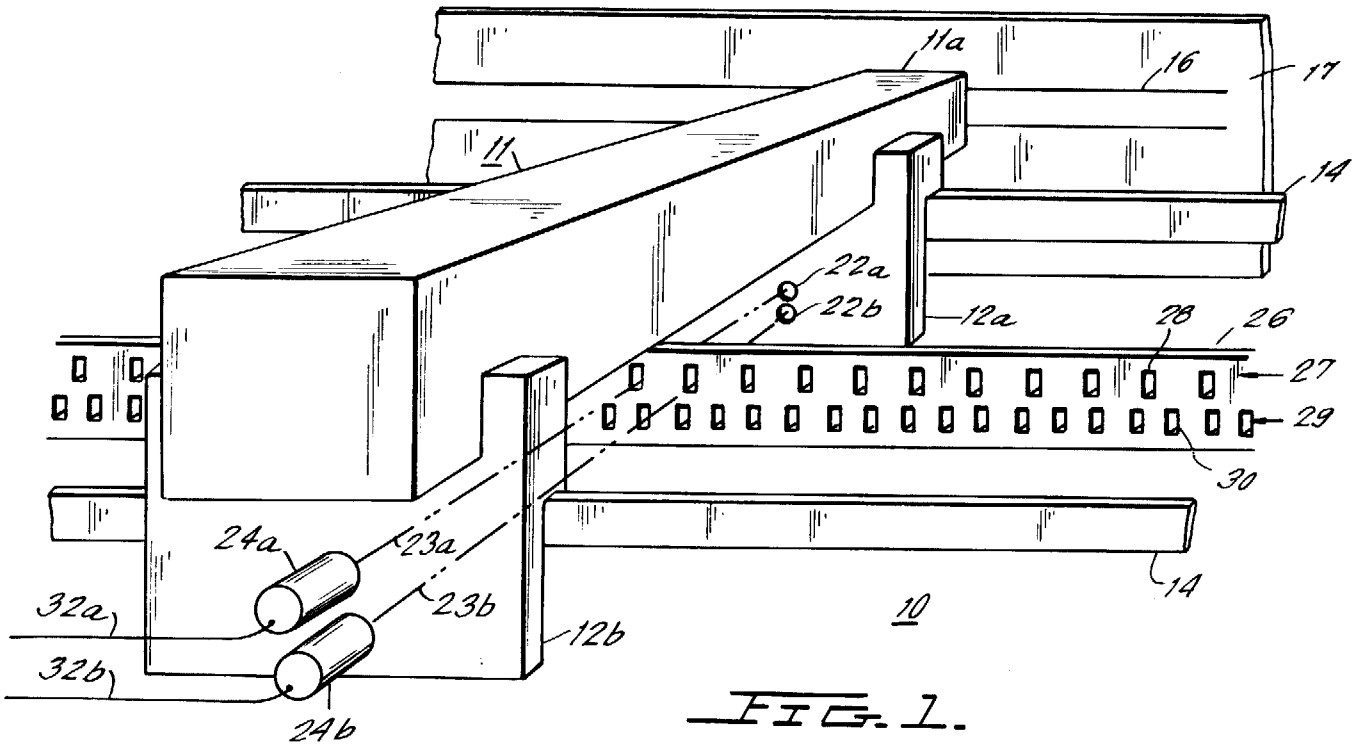
FIG. 1 is a perspective view of a registration strip and position determining means in accordance with the invention, and of a portion of a printer in which it is used.

Referring initially to FIGS. 1-3, a portion of a dot-matrix printer 10 includes a print head assembly 11 having a pair of spaced parallel supports 12*a* and 12*b* extended from the bottom surface thereof for slidably mounting print head assembly 11 upon a similarly spaced parallel pair of carriage rails 14. Print head assembly 11 includes means (not shown for simplicity) for selectively activating one or more of an aligned vertical row of print wires 15 outwardly in the direction of arrow A so that their tips extend from the nose 11*a* of print head 11 (FIG. 2). When activated, the tips of the print wires 15 impact an inked ribbon 16 against a paper document 17 to print a vertically aligned column of dots, typically seven in number.

After printing a first dot column for each character, print head 11, which is adapted to print "on the fly" moves a predetermined distance along carriage rails 14 and across paper document 17 in the direction of arrow B, and print wire tips 15 are again activated to print a second column of selective dot positions for the character or symbol being printed. The print head movement in the direction of arrows B and printing of selective dot positions at five equally spaced successive dot columns cooperatively forms a single character; a sixth dot column is left blank to provide a space(s) between successive characters in each printed line (FIG. 4*a*). In one typical dot-matrix printer, paper document 17 has a width of eight and a half inches, having a usable print line length of eight inches with allowance for margins. A typical 5×7 dot-matrix character prints ten characters per inch for a total of 80 normal-width font characters per line.

Print head 11 is adapted to print a succession of accurately and uniformly spaced dot columns by use of registration means 20 comprising a pair of vertically aligned light sources 22*a* and 22*b* positioned along flange 12*a* and adapted to emit beams 23*a* and 23*b*. A pair of vertically aligned light detection means 24*a* and 24*b*, such as photocells or the like, are respectively positioned along flange 12*b* and are aligned with light sources 22*a* and 22*b* respectively. It should be understood that the spacing between each light source and its associated detection means should preferably be small and the exaggerated spacing shown in FIG. I is merely for purposes of simplicity. Preferably, the light source and photocells may be mounted within a common housing as per copending U.S. Application Ser. No. 476,581 filed June 5, 1974.

The registration strip 26 is formed of an opaque material and, in one preferred embodiment (FIG. 3), has a first array 27 containing a plurality of uniformly spaced transparent slits 28 of uniform width and arranged above a second array 29 containing uniformly spaced transparent slits 30 of uniform width. As shown in FIG. 3, the spacing $S_1$ between the left-hand edges of successive slits 28 is greater than the spacing $S_2$ between like edges of successive slits 30.

Registration strip 26 is positioned between and parallel to carriage rails 14, so that the arrays 27 and 29 are respectively aligned with lamps 22*a* and 22*b*. The ends of registration strip 26 are suitably fastened to the frame (not shown) of printer 10 to arrange registration strip 26 in spaced parallel fashion relative to paper document 17. The aforementioned housing for the light sources and photocells (as per application Ser. No. 476,581) may be provided with a narrow slot for the strip 26.

The registration strip 26 is preferably adapted to be easily and rapidly replaceable to permit the substitution of other registration strip formats. For example, a registration strip having two arrays capable of selectively printing 12 characters per inch and 16 characters per inch may be mounted upon the printer as a replacement for the original strip.

It should be understood that strip 26 may be comprised of arrays each being comprised of alternating light and dark lines. The light source and photocell for each array may both be positioned on the same side of their associated array. The photocell may then be activated in accordance with the relative reflectivity of the alternating light and dark lines of the array.

In operation, the light from lamps 22*a* and 22*b* respectively is directed toward upper and lower arrays 27 and 29. The print head moves across the paper 17. The light rays reach the associated photodetector as they pass through each transparent slit. The light activated detector 24 produces an electrical signal responsive to light passing through a slit and impinging upon the detector, which electrical signal is amplified by a video amplifier 25*a* or 25*b* (FIG. 2) coupled to each respective light detection means 24*a* and 24*b*. The output signal (waveform A of FIG. 3*c*) of each video amplifier on video lines 32*a* and 32*b* (FIGS. 2 and 5) is normally at a first voltage level, hereinafter a logic zero, and appropriately changes to a second voltage level, hereinafter a logic one, only when one of the light sources and detectors is aligned with an aperture 28 or 30. The logic one pulse output signal from a selected one of the video amplifiers 25*a*, 25*b* is utilized, as hereinafter explained, to enable printing of dot columns at accurately spaced positions along the print line.

In another preferred embodiment, a registration strip 26' (FIG. 3*a*) comprises first and second arrays 27' and 29' respectively having slits 28' and 30', respectively, of a width equal to the respectively required spacings $S_1$ and $S_2$ and being spaced so that the distance between the left hand edges of successive slits is equal to twice the required spacing distance. Thus, the width of each transparent slit 28' or 30' respectively, is equal to the width of each opaque portion 26'*a* or 26'*b*, respectively, between successive slits. In this embodiment, the strobe pulses for activating print wire tips 15 are developed at both the leading and trailing edges of each slit, whereby only one-half as many slits are required to provide the same number of registration pulses for printing dot-columns, i.e., only 396 double width transparent slits 30' are required for a printer having a printing capacity of 132 characters per line, whereas 792 slits 30 are required with the "narrow-slot" registration array of FIG. 3 which generates only one registration pulse per slit.

Figure 3A:
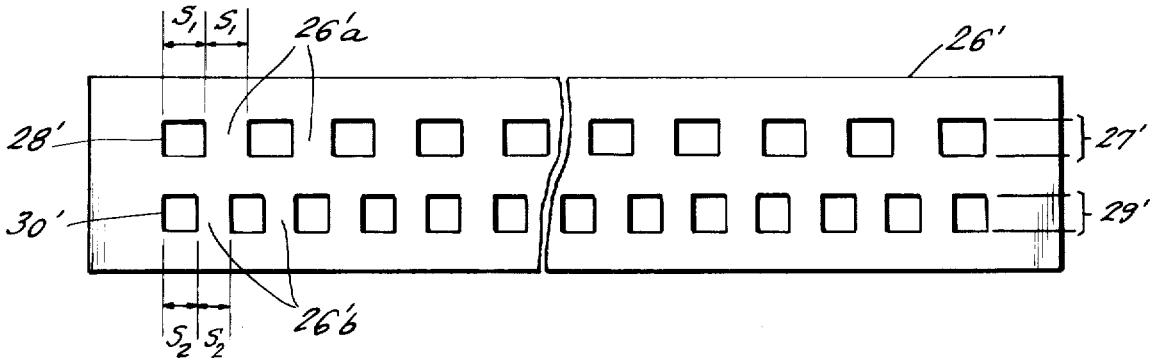
FIG. 3*a* is a front view of another preferred embodiment of a dual font format registration strip used in the apparatus of the invention.
Figure 3B:
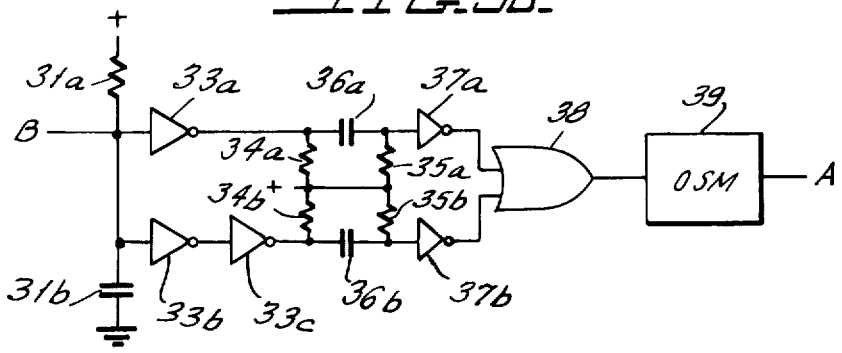
FIG. 3*b* is a schematic block diagram of logic means for providing a train of strobe signals when the registration strip of FIG. 3*a* is utilized.
Figure 3C:
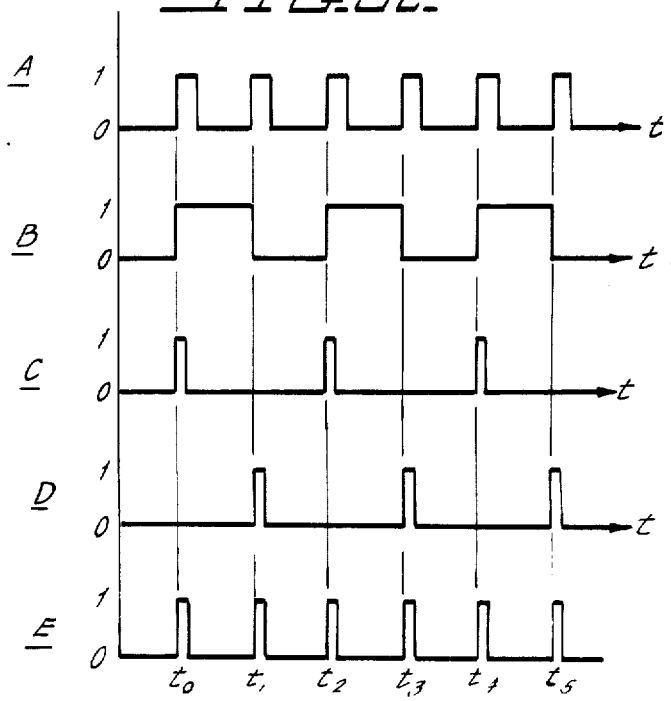
FIG. 3*c* is a set of graphs illustrating the various waveforms generated by utilization of the registration arrays of FIGS. 3 and 3*a;*

Waveform B of FIG. 3*c* shows the square waves generated on either video line 32*a* or 32*b* by the use of registration strip 26' of FIG. 3*a*. At $t_o$ the normally logic zero video level appropriately changes to a logic one level as the light rays from one of lamps 22*a* and 22*b* reach the associated photodetectors 24*a* or 24*b*. The logic one level is maintained until the light rays are cut off by an opaque portion 26'*a* or 26'*b* at time $t_1$, when the waveform returns to the logic zero level.

The output (waveform B) of each photodetector and the associated video amplifier 32*a* or 32*b* is applied (FIG. 3*b*) to the common terminal of a resistor 31*a* and a capacitor 31*b* which simultaneously applies the signal to inverters 33a and 33b. The output of inverter 33a is coupled to a differentiation circuit having resistors 34a and 35a and capacitor 36a. The output of the differentiator goes to inverter 37a whose output, represented by waveform C, generates a logic one level pulse for each leading edge of waveform B, is applied to OR gate 38. The common terminal between resistor 31a and capacitor 31b is coupled to inverter 33b whose output is coupled to inverter 33c. The output of inverter 33c is coupled to a differentiation circuit comprised of resistors 34b and 35b and capacitor 36b. The output of this differentiation circuit is applied to inverter 37b whose output, represented by waveform D generates a logic one level pulse for each trailing edge of waveform B, is applied to the remaining input of gate 38. The output of gate 38 serves to generate a positive going pulse at both the leading and trailing edges of waveform B as shown by waveform E. These pulses are sharpened and widened by a one shot multivibrator 39. The pulses shown by waveform E have a pulse width of the order of 2 microseconds and multivibrator 39 serves to lengthen the pulses to have substantially the same width as the pulses of waveform A whereby the output of multivibrator 39 is used to provide a strobe signal to enable printing of dot columns with the same accuracy as is obtained with a "fine" slit registration array 26 (FIG. 3).

Selection of the font format and actuation of means driving the print wire tips is controlled by font select logic section 40 (FIG. 5) utilized in conjunction with an existing known impact printer logic control means section 42 (For example, see above-mentioned application Ser. No. 476,581). Printer logic control means 42 comprises data storage means 44 receiving a 6-bit digital code in parallel fashion on character data input lines 46. A separate data strobe signal on line 48 enables storage of each character data input in data storage means 44. A logic 1 signal on data storage means output line 50 enables data storage means 44 to present the next character to be printed in the form of a 6-bit code to a plurality of output lines 52 coupled to character generator means 54.

In a typical 5×7 dot-matrix printer, the seven print wires 15, which constitute a "dot column", are selectively activated at each of five sequential dot-column positions to impact inked ribbon 16 and paper document 17. A logic 1 signal is presented on only one of five dot-column select lines 56 to cause character generator means 54 to selectively produce coded dot signals at its seven output lines 58. Each one of the character generator output lines 58 is coupled to one input, typically 60a, of each of seven 2-input print enable gates 60–67 respectively, each gate having another input, typically 60b, coupled to a print strobe line 68. When any of the seven print wire driver lines 69 have a logic 0 signal level, a selected one of print wires 15 is driven in the direction of arrow A when the associated one of character generator output lines 58 and print strobe line 68 are both at the logic 1 level.

The printer electronics further comprises decoder means 70 having its inputs coupled via lines 72 to the character data input lines 46 and to data strobe line 48. Decoder means 70 recognizes at least one special control code transmitted at the start of each line of characters to enable a logic 1 output on one of the pair of font select lines 74 coupled to font select logic 76, for purposes hereinafter more fully described. Font select logic 76 also receives the first and second video amplifier pulse output signals on video A and video B input lines 32a and 32b, respectively; a carriage return signal on line 77, indicative of the completion of a line of characters and a return of print head assembly 11 to the left-hand margin of paper document 17; and a font-preselect signal on line 78 from manually-operable select switch 80.

In a first position of select switch 80, line 78 is connected via switch contact 80a to a constant logic 1 level to enable font-select logic 76 to normally couple the video A input signals on line 32a to a font logic output 76a coupled to print-strobe line 68 to enable printing of a line of normal-width characters. In its remaining position, switch 80 couples font-select line 78 to a grounded switch contact 80b to present a constant logic 0 level to enable font select logic 76 to couple the video B input signals on line 32b to font logic output 76a and print-strobe line 68 to enable printing of a line of compressed-width characters.

Font select logic output 76a is also coupled to a first contact 82a of a two-position switch means 82 having its common contact coupled through line 84 to the input of counter means 86. Font logic output 76a is further coupled to the input of a divide-by-two means 88 having an output 88a connected to the remaining switch means contact 82b. The coupling of counter means input line 84 to font logic output 76a or divide-by-two means output 88a by switch means 82 is controlled by circuitry within font select logic 76, as indicated by dotted line 90. Although shown as an electromechanical switch, the switch means 82 may be a solid state switch.

In operation, the normal-width font of characters is selected by manually setting switch 80 to couple the positive logic 1 signal at switch contact 80a to font-select line 78. Data for a full line of characters to be printed is entered into data storage means 44 during the time interval in which print head assembly 11 returns to the left-hand most margin of paper document 17; counter-decoder means 86 is initialized to a count of zero responsive to a carriage return signal on line 77 during the return motion. The presence of a count of zero at counter means output 86a appears on data storage output enable line 50 to enable transfer of data for the first character of the line to be printed via lines 52 to code generator means 54.

Print head assembly 11 moves in the direction of arrow B until the light ray 23a passes through a first transparent slit 28a to enable a logic 1 output pulse on video A line 32a. This pulse is transmitted through font select logic 76 to increment counter means 86 and also enable print-strobe line 68 to enable print gates 60–67 to cause selective activation of the desired ones of print wires 15.

Illustrative printing of a first character Y requires a printed dot (FIG. 4a) only in the first and second dot rows $R_1$ and $R_2$ in the first dot column $C_1$.

Continued motion of print head assembly 11 moves the light source 23 beyond first slit 28a to change both the video A signal and font logic output signals to a logic 0 level. The falling edge of the logic signal advances counter means 86 to the next count, raising a different one of dot-column select lines 56 to the logic 1 level to enable presentation of the coded 7-bit dot column pattern on output lines 58 in readiness for printing the second dot-column. Continued motion of print head assembly 11 in the direction of arrow B permits light rays 23a to pass through the next slit 28b to provide another logic 1 video A pulse on line 32a and again raise font select output line 76a to the logic 1 level enabling print gates 60–67 and printing a dot in the third dot row $R_3$ of the second dot-column $C_2$ for the letter Y.

The cycle of undating the dot-column data on code generator means output lines 58 and then enabling printing of that dot-column responsive to the presence of sequential video A logic 1 pulses continues until five dot columns $C_1$–$C_5$ are completed. The return of the fifth video A pulse to the logic 0 state resets counter means output 86*a* to a count of zero placing a logic 0 level on data storage output enable line 50 to advance the 6-bit data code in storage means 44 for the next character to be printed via lines 52 to character generator means 54. A logic 0 level is present on each of coded data lines 58 responsive to counter means 86 being at a zero count to disable printing of any dot positions along the sixth, or character space, dot-column $C_6$. The above-described print cycle is repeated to print each successive character along the line to be printed.

The compressed-width character font format of FIG. 4*b* may be manually selected as the "normal" font format by operating switch 80 to connect font select line 78 via switch contact 80*b* to ground. A print cycle is enabled for each compressed-width character identical to the print cycle described for each normal-width character, utilizing the video B pulses on line 32*b* which are generated responsive to light rays 23*b* from source 23 passing through successive apertures 30*a*, 30*b*, . . . , 30*n* of aperture row 29 to achieve the uniform but more narrow spacing $S_2$ between dot-columns. When array 29 is utilized the printer is able to print a line of 132 characters.

The font format utilized for a selected print line is changed from the "normal" format, as manually selected by the position of switch 80, by presentation of a control code on lines 46 at the initiation of line data transfer into data storage means 44. The control code is decoded by decoder means 70 to raise one of font-change lines 74 to a logic 1 level. Circuitry internal to font select logic inverts the logic level on line 78 to allow the remaining one of video A and video B inputs 32*a* and 32*b* to be connected to font logic output line 76*a*. The internal circuitry remains latched in the position established by decoder means 70 until reset by the presence of a logic 1 level on return line 77 during carriage return after printing that line of code-selected format characters.

A line of elongated (i.e. double-width) characters (FIG. 4*c*) may be printed in either the normal-width or the compressed-width format responsive to the input of an appropriate control code on lines 46. The remaining one of decoder means output lines 74 is enabled to a logic 1 level upon decoding of the elongated character control code to cause switch means 82 to connect counter means input line 84 to divide-by-two means output 88*a* under the control of font select logic 76. As previously described hereinabove, line printing commences with the presence of a logic 0 level on return line 77 enabling counter means 86 and code generator means 54 to present the first seven-bit dot-column pattern to lines 58. Print head assembly 11 is moved during printing enabling one of the beams 23 to pass through a first slit 28*a* or 30*a* and activate the associated photocell to enable print-select line 68 to the logic 1 level and cause print wire tips 15 to print a dot on rows $R_1$ and $R_2$ for the first dot column $C_1$".

Since font logic output 76*a* is coupled to divide-by-two means 88, the counter 68 is advanced at one-half the normal rate causing two successive strobe pulses from the selected video amplifier (applied to gates 60–66) to occur during the time that each dot column pattern is present at the outputs of character generator 54 whereby each dot column pattern is printed twice.

Counter means 86 is advanced by one count after every dot-column has been printed twice, resulting in the desired elongated or double-width characters of FIG. 4*c*. Upon completion of printing of a line of elongated-width font characters, print head assembly 11 again returns to the left-hand margin of paper document 17 and font select logic 76 returns switch means 82 to its normal position coupling font select output line 76*a* through contact 82*a* to counter means input line 84 responsive to the presence of a logic 1 signal on return line 77. The next line will be printed in the "normal" format established by the position of font-select switch 80 unless the control code appears on data input lines 46 at the beginning of the data input sequence for that print line, to enable the remaining dot-column spacing and/or the double-width elongated format.

Figure 5A:
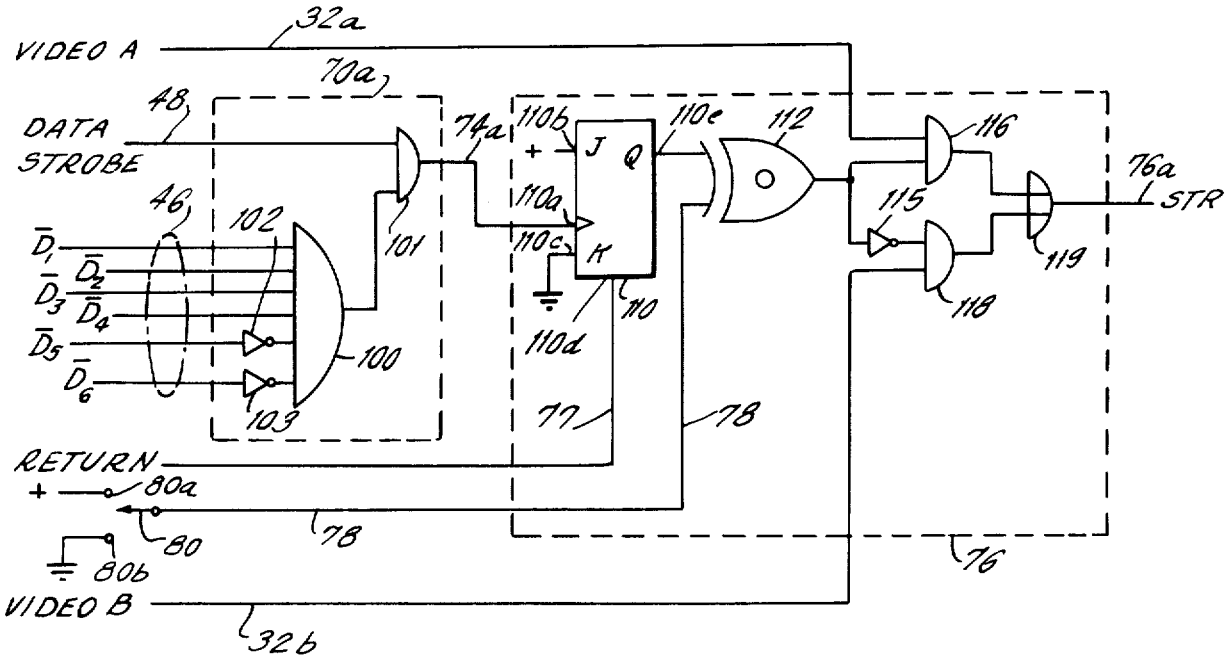
FIGS. 5*a* and 5*b* are schematic diagrams of portions of the logic means of FIG. 5.

Referring now to FIG. 5*a*, a preferred embodiment of a portion of font selection logic means 40 for selecting the desired one of the video A and video B signals to be coupled to font select logic output 76*a* comprises a first decoder means subsection 70*a* including a six-input AND gate 100 having its output coupled to one input of a two-input AND gate 101. Data strobe line 48 is coupled to the remaining input of AND gate 101. Negative-logic character data inputs $\overline{D}_1$–$\overline{D}_6$ are coupled to the inputs of AND gate 100 via lines 46. Illustratively, the "alternate-font" control code is represented by a negative-logic octal code $\overline{60}$ having a bit pattern of 111100 on data lines $\overline{D}_1$–$\overline{D}_6$, respectively. First and second inverters 102 and 103 are respectively coupled between data inputs $\overline{D}_5$ and $\overline{D}_6$ and the associated inputs of AND gate 100 to invert the logic zero levels for the fifth and sixth data bits to couple a logic one level to each input of gate 100 and enable a logic one output therefrom only when the actual $\overline{60}$ code is received. The presence of a logic one data strobe on line 48 at the remaining input of AND gate 101 provides a logic one pulse as the "alternate font" signal on first decoder output line 74*a*. The logic one pulse is coupled to the clock input 110*a* of a JK-type flip-flop 110 in font select logic 76. Flip-flop 110 has its J input 110*b* coupled to a positive potential, the logic one level, and its K input 110*c* coupled to ground, the logic zero level. The clear input 110*d* of flip-flop 110 is coupled to return line 77.

One input of an exclusive-OR gate 112 is coupled to the flip-flop Q output 110*e* and the other input is coupled via line 78 to font-select switch 80. The output of exclusive-OR gate 112 is simultaneously coupled to the input of an inverter 115 and to one input of a two-input AND gate 116 having its remaining input coupled to video A input line 32*a*. The output of inverter 115 is coupled to one input of another AND gate 118 having its remaining input coupled to video B input line 32*b*. The output of each AND gate 116, 118 is coupled to one input of a two-input OR gate 119 having its output coupled to font selected logic output line 76*a*.

In operation, assuming that the "alternate-font" control code is not received, the voltage on first decoder section output line 74*a* is at the logic zero level to inhibit clocking of flip-flop 110. A logic one level on return line 77 during carriage return clears flip-flop 110 to present a logic zero level on Q output 110*e*. If font preselect switch 80 has been manually operated to couple the logic one level at switch contact 80*a* to the line 78 (thereby selecting the normal width timing fence), the output of exclusive-OR gate 112 is at the logic one level enabling video A pulses to pass through AND gate 116 and OR gate 119 to font select logic output 76*a*. If font preselect switch 80 has been positioned to couple the logic zero level on contact 80*b* to line 78 (thereby selecting the compressed width timing fence), the output of exclusive-OR gate 112 is at the logic zero level inhibiting the transmittal of video A pulses to output 76*a*. The logic zero level is inverted by inverter 115 to appear as a logic one level at the associated input of second AND gate 118 and enable transmission of the video B pulses on line 32*b* through AND gate 118 and OR gate 119 to font select logic output 76*a*, thereby enabling printing of each dot column with the compressed spacing $S_2$.

Upon receipt of the "alternate-font" control code, a logic one level is transmitted along first decoder output line 74*a* to flip-flop clock input 110*a*. The logic one level at the J input 110*b* sets Q output 110*e* to the logic one level responsive to the energization of clock input 110*a*. The logic level at the output of exclusive OR gate 112 is now inverted, i.e., to a logic zero level enabling transmission of video B pulses to output 76*a* if line 78 was coupled to switch contact 80*a*, and to a logic one level enabling transmission of video A pulses to output 76*a* if switch line 78 was coupled to switch contact 80*b*, thus enabling printing of dot columns having the alternate spacing not previously selected by the position of preselection switch 80.

Upon completion of printing a line of characters with the "alternate-font" spacing, the presence of a logic one level on return line 77 clears flip-flop 110 to return its Q output 110*e* to the logic zero level and again enable transmission of the video A or video B signals as selected by the position of preselection switch 80, unless a new "alternate-font" code is received in first decoder section 70*a* prior to the commencement of the printing of the next line of characters.

Figure 5B:
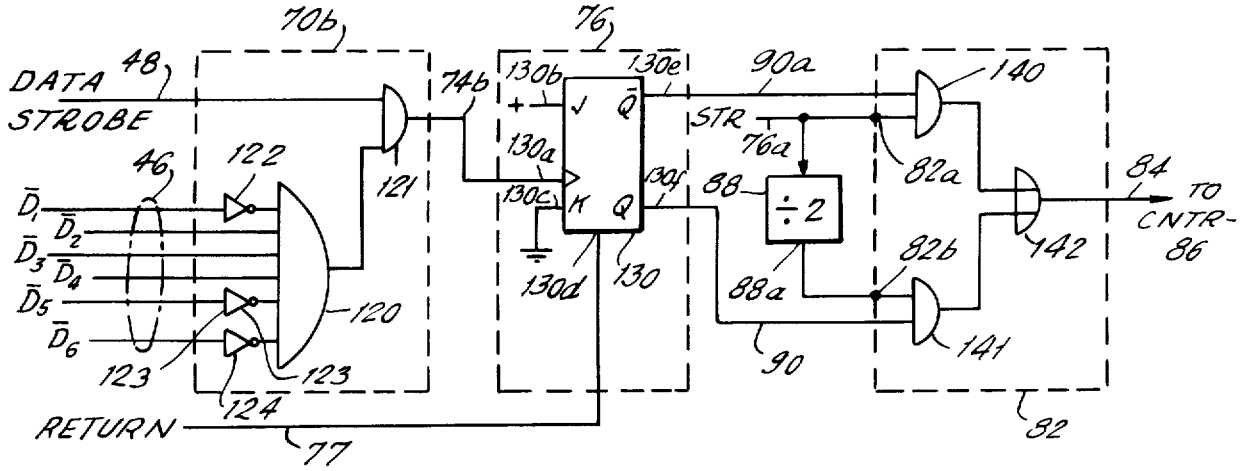

Referring now to FIG. 5*b*, a preferred embodiment of a portion of font selection logic means 40 for selection of elongated or double-width characters comprises a second decoder section 70*b* including another six-input AND gate 120 having its output coupled to one input of a two-input AND gate 121. The remaining input of AND gate 121 is coupled to data strobe line 48. The inputs of AND gate 121 are coupled via lines 46 to character data input lines $\overline{D}_1$-$\overline{D}_6$. Illustratively, the "elongated-font" control code is represented by a negative-logic octal code $\overline{61}$ having a bit pattern 011100 for data lines $\overline{D}_1$-$\overline{D}_6$, respectively. Logic inverters 122, 123 and 124 are respectively coupled between respective data inputs $\overline{D}_1$, $\overline{D}_5$ and $\overline{D}_6$ and the associated inputs of AND gate 120 to invert the logic zero levels and present a logic one level at each of the six inputs of AND gate 120 only when the octal $\overline{61}$ code is present to enable a logic one output level. The presence of a logic one level data strobe pulse on line 48 enables a logic one pulse on second decoder section output line 74*b* coupled to the clock input 130*a* of another JK-type flip-flop 130. The J input 130*b* and the K input 130*c* of flip-flop 130 are respectively coupled to fixed logic one and logic zero levels, while clear input 130*d* is coupled to return line 77.

In this embodiment, switch 82 comprises a pair of AND gates 140 and 141 each having its output coupled to one input of a two-input OR gate 142. Font select logic output 76*a* is coupled to one input of AND gate 140 and to the input of divide-by-two means 88 whose output 88*a* is coupled to one input of AND gate 141. The $\overline{Q}$ and Q outputs 130*e* and 130*f*, respectively, of flip-flop 130 are coupled via respective lines 90*a* and 90*b* to the remaining inputs of respective AND gates 140 and 141, while the output of OR gate 142 is coupled via line 84 to the input of counter means 86.

In operation, assuming the "elongated-font" control code has not been received, a logic zero level is transmitted via second decoder section output line 74*b* to clock input 130*a* to inhibit clocking of flip-flop 130. The presence of a logic one pulse on return line 77 clears flip-flop 130 to provide logic zero and logic one levels, respectively, at Q and $\overline{Q}$ outputs 130*f* and 130*e*. The logic one level at $\overline{Q}$ output 130*e* enables gate 140 to pass normal strobe signals from output 76*a* (FIG. 5*a*) through OR gate 142 and line 84 to advance the count of counter means 86 with each strobe signal. The logic zero at Q output 130*f* inhibits the transmission of strobe signals through gate 141, which signals undergo frequency division by the "divide-by-two" circuit 88.

Upon receipt of the "elongated-font" control code a logic one level appears on second decoder section output line 74*b* to clock flip-flop 130 in cooperation with the logic one level at the J input 130*b* thereof to establish respective Q and Q outputs 130*f* and 130*e* at the logic one and logic zero levels, respectively. The logic zero level at Q output 130*e* inhibits the transmission of normal strobe signals from output 76*a* to line 84 while the logic one level at Q output 130*f* enables transmission of the one-half rate strobe pulses from divide-by-two means output 88*a* through AND gate 141 and OR gate 142 to line 84. Thus, counter detector means 86 is advanced once for every two pulses of the strobe signals appearing at line 76*a*. Thus, print strobe line 68 receives two strobe signals from line 76*a* to cause each dot column to be printed twice before the counter decoder 86 is incremented.

Upon completion of a line of elongated characters, the presence of a logic one level on return line 77 clears flip-flop 130 to enable counter means 86 to be incremented on every strobe pulse from output 76*a*, unless an "elongated-character" control code is again received and decoded by second decoder section 70*b* prior to the commencement of printing of the next line of characters.

OPERATOR CHANGEABLE HORIZONTAL FORMATTING FEATURE

In the event that the report, order, or graphic presentation to be printed has a particular horizontal format, i.e., one that might have the following format:

| 10 | 20 | 5 | 20 | 5 | 40 | 30 | 12 |
|---|---|---|---|---|---|---|---|
| printed characters | space (blank) characters | printed characters | space (blank) characters | printed characters | space (blank) characters | printed characters | space (blank) characters |

and that this format would be repeatable for a given print run, the convention timing fence provided therefor would significantly increase throughput on serial printers as well as minimize memory space for a print line. The technique involved in creating the horizontal formatting is that the timing fence be designed for this particular format, i.e., where characters are to be printed timing fence slits are provided, and where characters are not to be printed, blank spaces (opaque areas) are provided. This horizontal formatting (or tabbing feature) provides compression of transmitted data in that the space or blank codes required in present day systems would not have to be transmitted. This timing fence is manufactured such that there is preferably an upper and lower array, one of which would be the horizontal format channel, the other of which would be the standard (i.e., either normal or compressed) font channel. This timing fence can be operator changeable such that if an operator desires to change the program that is being run to a different program, and therefore a different horizontal format is required, he would then easily be able to change the timing fence.

Figure 6:
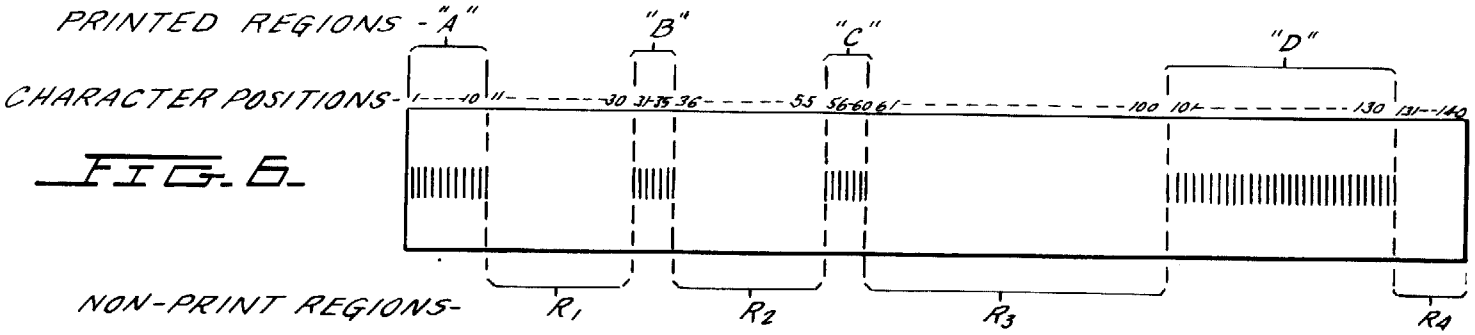
FIG. 6 is a plan view of a registration strip for use in horizontal formatting.

The spacing between slits in the horizontal formatting array may be of either the normal or compressed spacing. Also there may be more than one horizontal formatting array in each registration assembly. The strips for horizontal formatting arrays may also be independently mounted to the printer in applications where spatial relationships between and among the arrays mounted upon the printer are not critical. FIG. 6 shows the arrangement for the horizontal formatting technique.

The horizontal formatting technique may be employed in either dot matrix or character printers. The character codes stored in register 44 are coupled to a character selection means which replaces the character generator means and functions to move the selected print font provided, for example, on a drum or ball type print head, into the print position. Thus, the registration slits and the pulses developed therefrom each represent the position of a character (as opposed to a dot column within a character. The need for space codes traditionally required between a column of characters is eliminated by providing the registration strip with an opaque region between columns. For example, noting FIG. 6, column "A" is provided with slits sufficient to print characters in character positions 1-10; column "B" permits printing in character positions 31-35, etc. The opaque region "$R_1$" between regions "A" and "B" prevents printing in character positions 11-30; opaque region "$R_2$" between print regions "B" and "C" prevents printing in character positions 37-56, etc. The only difference between the registration strip used for dot-matrix printers and that used for character printers is that slits are provided for each dot column in the dot matrix printers whereas slits are provided (one per character) for full characters in the character printers.

The horizontal formatting strip may be used in conjunction with strips of the type shown in FIG. 1, for example, or a plurality of formatting strips may be employed, together with means for selecting the desired horizontal format.

While the present invention has been described with respect to a preferred embodiment thereof, many modifications and variations will now become apparent. It is preferred, therefore, that the present invention be limited not by specific disclosure herein, but only by the appended claims.

What is claimed is:

1. Apparatus for printing a line of characters on a paper document in a selected one of a plurality of character sizes for use in a dot-matrix printer having a print head assembly movable across the paper document and having a plurality M of print wire driving means, each of said characters formed within a predetermined dot matrix of N dot columns having M dots in each column, said apparatus comprising:

a registration assembly having a plurality of arrays of spaced indicia, the spacing between and among indicia in each of said arrays being different from the spacing between and amomg indicia in every other array, said arrays extending at least partially across the paper document;

a plurality of means mounted on said head assembly for respectively sensing the indicia in each of said arrays for respectively generating registration pulses;

an output line;

switching means for selectively coupling the registration pulses generated by one of said sensing means to said output line;

means responsive to the registration pulses coupled to said output line for cyclically generating a succession of groups of dot column selection signals;

character generator means;

means for storing character codes representing each character and symbol to be printed;

means responsive to each completed group of said dot column selection signals for applying the next character code to said character generator means;

said character generator means generating print signals representing a dot column pattern determined by the character code in said storing means and by the dot column selection signal coupled thereto;

said print wire driving means being adapted to receive said print signals for printing the dot column pattern outputted by said character generator means.

2. Apparatus as set forth in claim 1, further comprising pulse rate control means coupled between said switching means and said dot column selection signal generating means and responsive to an elongated character control code for reducing the output rate of pulses applied to the pulse rate control means by said switching means, whereby each dot column of a character is successively printed a plurality of times to print an elongated character.

3. Apparatus as set forth in claim 2, wherein the output rate of the registration pulses passed by said switching means is reduced by a factor of two so that each dot column is printed twice.

4. Apparatus as set forth in claim 3, wherein said dot matrix printer further comprises means for returning said print head assembly across said paper document after a line of said characters is printed, and means coupled to said returning means for generating a return signal; said pulse rate control means comprising first decoder means for generating a first control signal responsive to the receipt of said elongated character control code; first latch means for storing said first control signal during the printing of an entire line of elongated characters; counter means coupled to said output of said switching means for dividing the pulses thereat by a factor of two; and gating means for coupling said output of said counter means to said dot column selection means responsive to said first control signal at said first latch means; said first latch means being cleared of said first control signal responsive to said return signal.

5. Apparatus as set forth in claim 1, wherein each sensing means is further comprised of light generating means movable with said print head assembly for emitting light and light sensing means coupled to said print head for sensing light reflected from an associated array to generate registration pulses;

each array of said registration strip comprising a pattern of alternating light and dark lines.

6. Apparatus as set forth in claim 1, wherein each sensing means is comprised of light generating means movable with said print head assembly for emitting light and light sensing means coupled to said print head for sensing light passing through said array to generate registration pulses;

each array of said registration strip comprising a plurality of equi-spaced transparent slits.

7. Apparatus as set forth in claim 6, wherein each of said plurality of equi-spaced slits has a width between a leading edge and a trailing edge thereof equal to one-half the distance between the leading edges of any adjacent pair of said plurality of slits; and further comprising fifth means for generating one of said registration pulses at each of said leading and trailing edges of each of said slits.

8. Apparatus as set forth in claim 1, wherein said arrays are arranged on said registration strip in spaced parallel fashion, each of said arrays being arranged substantially in horizontal fashion;

each of said sensing means being positioned adjacent its associated array.

9. Apparatus as set forth in claim 1, wherein said switching means comprises means for decoding each of a plurality of font select control codes to generate each of a plurality of font control signals; latch means for storing each of said font control signals during the printing of an entire line of characters; and gating means for enabling passage of said registration pulses from one of said sensing means responsive to the presence of an associated font control signal.

10. Apparatus as set forth in claim 9, wherein said printer further comprises means for returning said head assembly across said paper document after a line of characters is printed and means coupled to said returning means for generating a return signal; said switching means further comprising means for clearing said font control signals from said latch means responsive to said return signal.

11. Apparatus as set forth in claim 10, wherein said switching means further comprises means coupled to said gating means for manually selecting a character font to be used in the absence of the receipt of any of said plurality of font select control codes; said manual selection means establishing the character font to be printed, unless one of said plurality of font select control codes is received after each return signal to establish another character font format.

12. The apparatus of claim 1 wherein one of said arrays comprises a plurality of groups of uniformly spaced indicia, the spacing between and among indicia in all of said groups of said one array being substantially equal; said groups being arranged end-to-end and extending at least partially across the paper document;

the regions between each group being devoid of indicia.

13. Apparatus for selectively printing graphic information in accordance with a desired horizontal format comprising:

a print head assembly movable across the paper document and having a plurality M of print wire driving means, each of said characters formed within a predetermined dot matrix of N dot columns having M dots in each column, said apparatus comprising:

a registration assembly having a plurality of arrays each having uniformly spaced indicia; one of said arrays having groups of indicia arranged end-to-end and extending at spaced intervals at least partially across the paper document; the regions between adjacent groups being devoid of any indicia;

a plurality of sensing means mounted on said head assembly for respectively sensing the indicia in each of said arrays for respectively generating registration pulses;

an output line;

switching means for selectively coupling the registration pulses generated by one of said sensing means to said output line;

means responsive to the registration pulses coupled to said output line for cyclically generating a succession of groups of dot column selection signals;

character generator means;

means for storing character codes representing each character and symbol to be printed;

means responsive to each completed group of said dot column selection signals for applying the next character code to said character generator means;

said character generator means generating print signals representing a dot column pattern determined by the character code in said storing means and by the dot column selection signal coupled thereto;

said print wire driving means being adapted to receive said print signals for printing the dot column pattern outputted by said character generator means.

14. Apparatus for printing a line of characters on a paper document in a selected one of a plurality of character widths for use in a dot-matrix printer having a print head assembly movable across the paper document and having a plurality M of print wire driving means, each of said characters formed within a predetermined dot matrix of N dot columns having M dots in each column, said apparatus comprising:

a registration assembly having a plurality of arrays of spaced indicia, the spacing between and among indicia in each of said arrays being different from the spacing between and among indicia in every other array;

a plurality of means each respectively sensing the indicia in an associated one of said arrays upon movement of said head assembly for respectively generating registration pulses whereby relative movement between said sensing means and said arrays causes generation of the registration pulses during movement of the head assembly;

an output line;

switching means for selectively coupling the registration pulses generated by one of said sensing means to said output line;

means responsive to those registration pulses coupled to said output line for cyclically generating a succession of groups of dot column selection signals;

character generator means;

means for storing character codes representing each character and symbol to be printed;

means responsive to each completed group of said dot column selection signals for applying the next character code to said character generator means;

said character generator means generating print signals representing a dot column pattern determined by the character code in said storing means and by the dot column selection signal coupled thereto;

said print wire driving means being adapted to receive said print signals for printing the dot column pattern outputted by said generator means.

15. Apparatus as set forth in claim 14, wherein said switching means comprises settable means for selectively coupling one of said sensing means to said output line; means responsive to a character size control code to generate a character size control signal; latch means for retaining the character size selected during the printing of a line of characters; and means responsive to the character size control signal for switching the output of another one of said sensing means to said output means responsive to the receipt of a character size control signal.

16. Apparatus as set forth in claim 15, wherein said printer further comprises means for returning said head assembly across said paper document after a line of characters is printed and means coupled to said returning means for generating a return signal; said switching means further comprising means for clearing said character size signal from said latch means responsive to said return signal.

* * * * *